United States Patent [19]

Malbec

[11] Patent Number: 4,702,679

[45] Date of Patent: Oct. 27, 1987

[54] PERISTALTIC PUMP

[76] Inventor: Edouard Malbec, Logis de Chalonne 16160 Le Gond, Pontouvre, France

[21] Appl. No.: 591,225

[22] Filed: Mar. 19, 1984

Related U.S. Application Data

[63] Continuation of Ser. No. 269,337, Jun. 1, 1981, abandoned.

[30] Foreign Application Priority Data

Jun. 3, 1980 [FR] France ..... 80 12292

[51] Int. Cl.[4] ..... F04B 43/12; F04B 45/08

[52] U.S. Cl. ..... 417/475; 417/477

[58] Field of Search ..... 417/477, 476, 475

[56] References Cited

U.S. PATENT DOCUMENTS 2,899,907 8/1959 Becher ..... 417/477

FOREIGN PATENT DOCUMENTS 137589 2/1949 Australia ..... 417/477
2383333 10/1978 France ..... 417/477
1023193 3/1966 United Kingdom ..... 417/477

*Primary Examiner*—Richard E. Gluck
*Attorney, Agent, or Firm*—Frishauf, Holtz, Goodman & Woodward

[57] ABSTRACT

A peristaltic pump having a deformable tube (11) forming the pump body, placed between rollers (15, 16) driven by friction from a central drive shaft (6), and located in an external casing (1) forming runways (13, 14) for the rollers, positioned on either side of a groove (10) in the tube housing. Each roller (15) engaging the tube (11) is rigid in its center section where it acts on the tube, but is elastically deformable at its ends which are running on the runways (13, 14).

21 Claims, 5 Drawing Figures

PERISTALTIC PUMP

This application is a continuation, of application Ser. No. 269,337, filed June 1, 1981 now abandoned.

The present invention relates to peristaltic pumps of the type in which a deformable tube, forming the pump body, is placed between rollers engaging by friction with a central drive shaft, and an outer casing forming runways for the rollers on either side of a tube housing recess or groove.

BACKGROUND

It is known that the performance and lifetime of peristaltic pumps, can be improved by using rollers thereof as the bearing of the drive shaft; to use at least one non-working roller; and to use at least one roller which is elastically deformable.

Peristaltic pumps have the advantage of being capable of being manufactured at low cost since the mechanical system can be made entirely from parts of moulded plastic material. Yet they can operate at very high rotational speeds, making it possible to use small high speed direct current motors e.g. capable of exceeding 20,000 revolutions per minute. Such motors are cheap, making them particularly suitable in windshield and headlight washer pump applications for vehicles. Peristaltic pumps are also used for laboratory and medical applications or for applications in equipment distributing various liquids.

At such high working speeds, the moving parts are heavily stressed. Unavoidable friction leads to undesirable heating or wear; the optimum operation, considering frictional force, rotational speed and pump fluid output pressure is difficult to achieve from a given motor.

THE INVENTION

It is an object to provide a peristaltic pump with improved operating characteristics. Briefly, the peristaltic pump has a deformable tube forming the pump body, which is placed between roller frictionally engaging a central drive shaft. An outer casing forms runways for the rollers on either side of a tube housing with a groove therein. In accordance with the invention, each roller cooperating with and engaging the tube has a rigid center section pressing the tube in the groove while it is elastically deformable at its ends engaging with the runways.

To optimize operation and lifetime, the peristaltic pump comprises at least one non-working roller with a hub straddling the tube and having ends which are, preferably, also elastically deformable.

A further improvement is obtained by using a roller guide system comprising, a rotatable plate having cantilevered shafts thereon. The plate is located in the casing at the end of the drive shaft. The hubs of the rollers project laterally so as to axially butt against the plate. The guide-spacer plate may have a rotating connection locating it in the casing, just as a similar rotating location connection can also be provided with the central drive shaft.

The system of the invention permits use of micromotors with power ratings below those heretofore used, with equal pumping performance or enabling relatively higher pressures than usual to be obtained, while having enhanced tube life. The presence of non-working rollers permits tubes of smaller diameter, which are more wear resistant to obtain a given flow rate, and a number of these tubes can be used in parallel or separately connected as the case may be.

DRAWINGS

Figure 1:
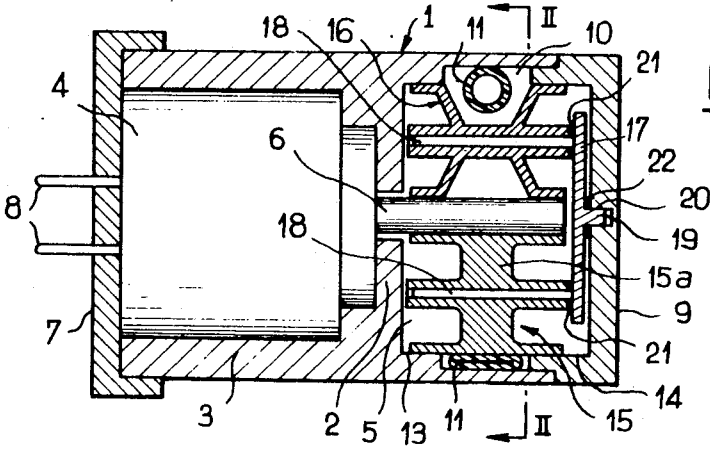
FIG. 1 is an axial section view of a peristaltic pump according to the invention.
Figure 2:
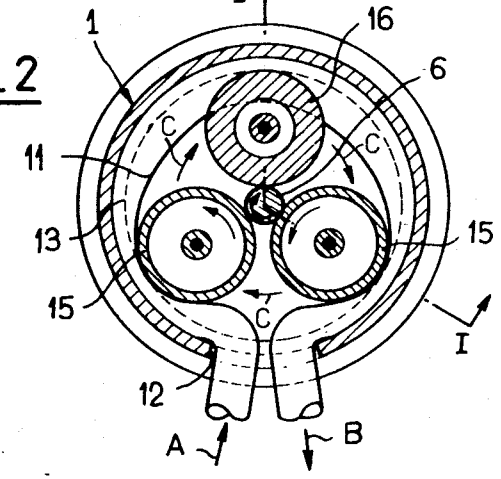
FIG. 2 is a cross-sectional view of this pump along II—II in FIG. 1.

The pump shown in FIGS. 1 and 2 comprise a motor and a generally cylindrical tubular pump casing 1, containing a middle wall 2 which separates a motor 4 in motor housing 3 from a pump mechanism housing 5. The motor shaft 6 runs through wall 2 and forms the central pump drive shaft. This casing is completed at its ends by a motor retainer cover 7 on one side with the motor's electrical connection tabs 8 passing through it, and on the other side by a pump mechanism retainer cover 9.

Casing 1 is formed with a circular groove 10 adjacent cover 9. Groove 10 receives a deformable tube 11 made from an elastomer, the ends of which are led out of casing 1 through a groove opening 12 made in the casing 1. On either side of the groove 10, the casing 1 and the cover 9 respectively form circular runways 13, 14.

Three rollers are running on these runways 13 and 14. The three rollers comprise two rollers 15 working on, and cooperating with the tube; and a non-working roller 16. All three rollers are mounted in close contact with the central drive shaft 6. They are made of plastics material, e.g. of DELRIN or of RYTON (registered trade marks).

Each working roller 15 has an overall cylindrical shape which is solid in the middle as shown at 15*a* (FIG. 1) so as to be absolutely rigid with respect to the tube 10 whose walls it pushes into sealing contact along its rim at one outer surface line; A diametrically opposite surface line of the roller is in contact with shaft 6. The end portions of the rollers run along the runways 13 and 14. They are tubular so as to be elastically deformable in operation.

The non-working roller 16 is made in the shape of a dual rim wheel with the mid section straddling the tube and with the ends running on runways 13 and 14. The end portions are radially hollow to form elastically deformable running members.

These three rollers are set 120° apart and so held by means of a guide-spacer plate 17. Plate 17 is inserted in an axial space in the housing. Pins 18 project centrally in the rollers, forming three cantilevered shafts or pins 18. Plate 17 extends over the end of the drive shaft 6. It is secured by a rotatable connection in the cover 9, formed by a pin 19 inserted in a corresponding hole 20 in the cover 9. Thus the three cantilevered shafts of pins 18 project from said plate 17 into axial passageways, in the form of central holes, formed in the middle section of the rollers. The plate 17 is located between the end of the drive shaft 6 and the cover 9 and has a bearing connection with the cover, provided by a pin 19 inserted in a corresponding hole 20 in the cover.

Inspection of FIG. 2 will show that two working rollers are enough to provide a pump which, when at rest, provides a sealed stop. In operation, it has a continuous output. One of the rollers 15 will have already compressed the intake tube (arrow A) before the other has left the delivery side (arrow B). If there is no requirement for sealing when stopped it is possible, as a variant, to use only one working roller 15 and two non-working rollers 16. The direction of rotation of the pump components are shown by arrows C in FIG. 2, assuring that liquid intake is along arrow A and delivery along arrow B.

It has been observed that in a pump of this type the rollers are subject to a unidirectional axial force depending on the direction of rotation of the motor. An axial thrust stop, in accordance with a preferred feature, is provided. For the indicated direction of rotation of the motor (arrow C), an anti-friction washer 21 is inserted between the hub of the rollers 15, 16 to space the rollers slightly from the plate 17. The guide-spacer plate 17 can also be provided in the center section i.e. surrounding pin 19 with an anti-friction washer 22 to space plate 17 from the casing cover 9.

It has been observed that the structure of the working roller(s) with differential deformation is decisive in obtaining high pressures and a low friction drive bearing capable of operating at high speed and of itself forming the drive shaft bearing. In addition, using a guide-spacer plate 17 like the one described leads to better efficiency than any other roller spacer cage solution which could be used here. Finally using one or a greater number of non-working rollers offers the advantages already mentioned in the introduction, of extended life and of improved tube selection for any given performance.

In a windshield washer pump application for automotive vehicles, for example, an embodiment can be used in which two tubes are placed in parallel, each feeding an individual spray nozzle; or even a third tube, e.g. for feeding headlight spray nozzles.

In order to obtain both relatively high pressures and volume outputs for this kind of pump, several tubes can be used in parallel with separate intake, or a shared intake through an intake manifold and with shared delivery through an output manifold.

Figure 3:
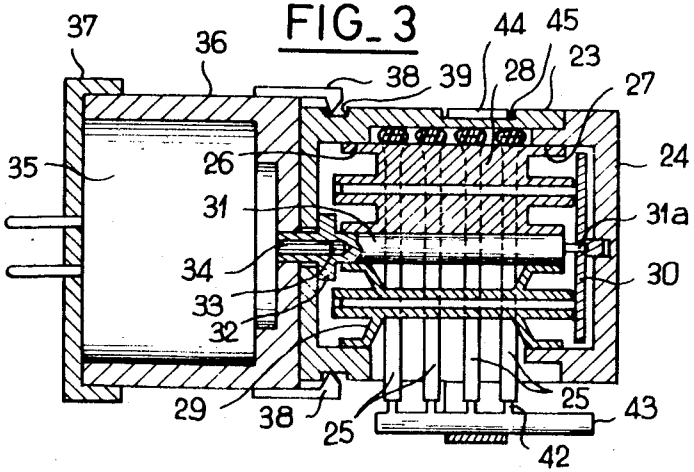
FIG. 3 is an axial section view of another embodiment of a pump according to the invention.
Figure 4:
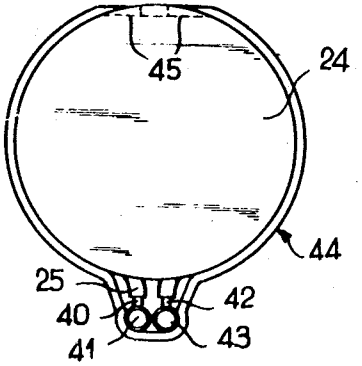
FIG. 4 is an end view from the pump casing side of FIG. 3.

This kind of solution is illustrated in FIGS. 3 and 4 on the basis of a pump designed in the form of an interchangeable cassette consisting of a casing 23 and a cover 24 forming, as before, the tube 25 housing groove and making up the runways 26 and 27 for the working rollers 28 and non-working rollers 29 which are similarly mounted on a guide-spacer plate shown generally at 30. Rollers 28, 29 work in conjunction with a drive shaft 31 having a retainer shoulder 32 keeping it in the casing and possessing a polygonal interval cross-section 33 enabling it to be stuck onto the output shaft 34 having a corresponding polygonal cross-section, of motor 34. The plate 30 here also has a rotating connection for locating shaft 31. Shaft 31 has a small diameter pin 31a inserted in a corresponding female housing in plate 30.

The motor 35 has its own casing 36, with a cover 37, which is provided on its output shaft side with three elastic holding claws 38 holding the cassette by engaging with a retainer groove 39 made in the pump casing 23 so that the cassette can be fitted onto shaft 34 and held elastically in a self-locating position on this shaft by means of the claws 38, yet removable from the motor casing 35 by simply pulling out the elastic claws 38.

The four tubes 25 are here respectively connected on the intake side to the connections 40 of the intake manifold tube 41 and on the delivery side to the connections 42 of a delivery manifold tube 43 (FIG. 4); these tubes can be held in position relative to each other and to the pump casing 23 by means of a suitably shaped elastic clip 44 (FIG. 4) and which both mates by its shape with the manifolds 41 and 43 and by means of its free arms with the pump casing at 45.

Figure 5:
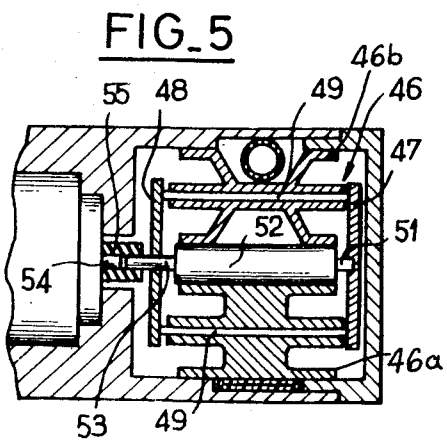
FIG. 5 is an axial section view of another embodiment of a pump according to the invention.

FIG. 5 illustrates another embodiment version mainly involving reinforced guidance of the rollers suitable for higher output and slower speed pumps than those of the above-mentioned applications.

In this case a cage 46 is formed comprising two plates 47 and 48 which connect shafts 49 running through the hubs of rollers, **46*a*, 46*b*; these plates have a rotating location connection consisting, for plate 47 of a small diameter pin 51 continuing the central drive shaft 52, and for plate 48 of a small diameter pin 53 drive shaft 52, and for plate 48 of a small diameter pin 53 forming the pin coupled to the drive motor shaft 54, to which it is here connected by means of a flexible coupling formed by a rubber sleeve 55 force-fitted onto pin 53** and the motor shaft.

Such pumps can also be advantageously operated on a simple electricity supply from a photovoltaic cell.

Various other changes may be made within the scope of the invention.

I claim:

1. A peristaltic pump comprising a cylindrical tubular housing (1, 23) formed with a circumferential groove (10) in the inner wall thereof;

a motor (4, 35) secured to the housing and having a central shaft (6; 31–34; 52–54) extending axially into the housing;

a plurality of rollers (**15, 16, 29, 28, 46*a*, 46*b***) located in the housing, radially adacent the shaft and engaging the central shaft at an engagement line;

an elastic tube means (11) located in the groove (10); and wherein the inner wall surface of the housing is formed with a pair of runways (13, 14; 26, 27) axially located along both sides of the groove (10);

the rollers have an axial length spanning the groove and engaging the runways, and wherein at least one of the rollers comprises a solid rigid center section in alignment with the groove, the rigid center section of said at least one roller engaging the elastic tube means; and elastically deformable end sections in engagement with the runways.

2. Pump according to claim 1 wherein at least one of the rollers comprises a non-working roller having a center section which is diametrically relieved to straddle the tube means.

3. Pump according to claim 2 wherein the end sections of the non-working roller (16) are in engagement with the runways and are elastically deformable.

4. Pump according to claim 1 further including a guide-spacer cage structure (47, 48, 49) located within the cylindrical tubular housing, said structure including axially extending guide shafts (49), said rollers being mounted on said guide shafts.

5. Pump according to claim 1 wherein said cylindrical tubular housing, said rollers therein, and said elastic tube forms a unit, separable from the motor;

and further including an integral central drive shaft element located within said separable unit and engageable with the central shaft.

6. Pump according to claim 5 further including a flexible coupling engaging the drive shaft element and the central shaft, said central shaft being integral with the motor.

7. Pump according to claim 1 wherein a plurality of tubes (25) are located in said groove;

and manifold connection means (41, 43) are provided, connecting said plurality of tubes in parallel.

8. Pump according to claim 1 wherein a plurality of tubes are located in said cylindrical groove (10) and having individual input and output elements (40, 42).

9. Pump according to claim 1 wherein the plurality of rollers comprises three rollers, two rollers having an outer cylindrical surface in engagement with said tube means forming said rigid center section centrally of said elastically deformable end sections engaging the runways:

and one roller having a center section which is diametrically relieved to straddle the tube means and forming a non-working roller, said non-working roller having elastically deformable end sections in engagement with said runways.

10. Pump according to claim 1 wherein said at least one roller comprises a hub-like solid middle section and two tubular end sections.

11. Pump according to claim 9 further comprising a guide and spacer plate located axially remote from the motor within the cylindrical pump housing and shaft means projecting from said plate axially parallel to the motor shaft and forming guide shafts for the rollers, the rollers rotating on said guide shafts, the diameters of the rollers and the spacing of the shaft means being dimensioned to maintain the outer surfaces of the rollers out of contact with each other.

12. A peristaltic pump comprising a casing having a cylindrical inner wall formed with a circumferential groove in the inner wall thereof and with two cylindrical runways, each located on one side of said groove;

a deformable tube located in said groove, its both ends being led out of the casing through an opening made in the groove;

a central shaft driven by a motor adapted to be secured at one axial end of the casing and extending axially into said casing; and a plurality of rollers located between and in contact with the said shaft and the inner wall of the casing, including at least two elastically deformable rollers, each having a rigid middle section and two elastically deformable end sections, said tube being engaged by the rigid middle section, the two elastically deformable end sections engaging said runways.

13. The pump according to claim 12, wherein the said at least two rollers comprise a hub-like solid middle section and two tubular end sections.

14. The pump according to claim 12, further including at least one roller which comprises a relieved middle portion straddling the tube and two elastically deformable end sections engaging the said runways.

15. Pump according to claim 12, wherein the said at least two rollers comprise a hub-like solid middle section and two tubular end sections, and the pump further includes a guide and spacer plate located inside the casing between the end wall of the casing axially remote from the motor and the corresponding end of the rollers and a plurality of cantilever shafts projecting axially from said plate into the said rollers which are rotating on said shafts.

16. Pump according to claim 12 wherein the said at least two rollers comprise a hub-like solid middle portion and two tubular end sections, said plurality of rollers further include at least one non-working roller which comprises a relieved, or grooved middle portion straddling the tube and two tubular elastically deformable end sections engaging the said runways, and the pump further includes a guide and spacer plate located inside the housing between the end wall of the casing axially remote from the motor and the corresponding end of the rollers, and a plurality of cantilever shafts projecting axially from said plate into the said rollers which are rotating on said shafts, the spacing of the cantilever shafts being dimensioned to maintain the outer surfaces of the rollers out of mutual contact.

17. A peristaltic pump comprising:

a casing having two opposite end walls and a cylindrical inner wall formed with a circumferential groove therein and with two cylindrical runways each located on one side of said groove, a deformable tube means located in said groove, its both ends being led out of the casing through an opening made in the groove;

a central shaft driven by a motor adapted to be secured at one axial end of the casing corresponding to one of said end walls, said shaft extending axially into said casing with its free end near the other of said end walls;

a plurality of rollers located between and in contact with the said shaft and the inner wall of the casing, including at least two rollers each having a hub, a rigid hub-like middle section on the hub and two elastically deformable tubular end sections, said tube means being engaged by the rigid middle section and the two elastically deformable end sections engaging said runways;

and a guide and spacer means comprising a plate located inside the casing between the said other end wall and the said free end of the control shaft, and a plurality of pins projecting from said plate axially parallel to said shaft, each said pins being inserted into a central passageway extending axially throughout each said roller, whereby the outer surfaces of the rollers are maintained out of mutual contact when said rollers are rotated on said pins by engagement with said central shaft.

18. The pump according to claim 17, wherein the hub of each said roller projects axially beyond at least one end section thereof, said hub butting against the said plate.

19. The pump according to claim 17, further comprising anti-friction means surrounding said pins and mounted between said hub and said plate.

20. Pump according to claim 17 further including a rotary locating connection between the guide plate and the central shaft (31–34).

21. A peristaltic pump comprising:

a casing having two opposite end walls and a cylindrical inner wall formed with a circumferential groove therein and with two cylindrical runways each located on one side of said groove;

a deformable tube means located in said groove, its both ends being led out of the casing through an opening made in the groove;

a central shaft driven by a motor adapted to be secured at one axial end of the casing corresponding to one of said end walls, said shaft extending axially into said casing with its free end near the other of said end walls;

a plurality of rollers located between and in contact with the said shaft and the inner wall of the casing, including at least two rollers each having a hub, a rigid hub-like middle section on the hub and two elastically deformable tubular end sections, said tube means being engaged by the rigid middle section and the two elastically deformable end sections engaging said runways;

and a guide and spacer means comprising a plate located inside the casing between the said other end wall and the said free end of the control shaft, and a plurality of pins projecting from said plate axially parallel to said shaft, each said pins being inserted into a central passageway extending axially throughout each said roller whereby the outer surfaces of the rollers are maintained out of mutual contact when said rollers are rotated on said pins by engagement with said central shafts; each said rollers having its hub projecting axially beyond at least one end section thereof, said hub butting against the said plate, and anti-friction means surrounding said pins being mounted between said hub and said plate.

* * * * *